US011311763B2

(12) United States Patent
Yeates et al.

(10) Patent No.: US 11,311,763 B2
(45) Date of Patent: Apr. 26, 2022

(54) SUSPENDIBLE EXERCISE STRAP

(71) Applicants: Jonathan Drew Yeates, Woods Cross, UT (US); Tyler Yeates, Bountiful, UT (US)

(72) Inventors: Jonathan Drew Yeates, Woods Cross, UT (US); Tyler Yeates, Bountiful, UT (US)

( * ) Notice: Subject to any disclaimer, the term of this patent is extended or adjusted under 35 U.S.C. 154(b) by 35 days.

(21) Appl. No.: 16/874,436

(22) Filed: May 14, 2020

(65) Prior Publication Data

US 2021/0353991 A1 Nov. 18, 2021

(51) Int. Cl.

| | |
|---|---|
| ***A63B 21/00*** | (2006.01) |
| ***A63B 21/018*** | (2006.01) |
| ***A63B 21/055*** | (2006.01) |
| ***A63B 21/068*** | (2006.01) |
| ***A63B 21/002*** | (2006.01) |

(52) U.S. Cl.

CPC ..... *A63B 21/00043* (2013.01); *A63B 21/018* (2013.01); *A63B 21/055* (2013.01); *A63B 21/4035* (2015.10); *A63B 21/4043* (2015.10); *A63B 21/0023* (2013.01); *A63B 21/068* (2013.01)

(58) Field of Classification Search

CPC ..... A63B 21/00043; A63B 21/018; A63B 21/4043; A63B 21/4035; A63B 21/055; A63B 21/0023; A63B 21/068

See application file for complete search history.

(56) References Cited

U.S. PATENT DOCUMENTS

| | | | | |
|---|---|---|---|---|
| 3,119,614 | A * | 1/1964 | Berry | A63B 21/0023 482/91 |
| 4,909,505 | A * | 3/1990 | Tee | A63B 21/00043 482/121 |
| 5,209,712 | A * | 5/1993 | Ferri | A61H 1/02 482/131 |
| 6,322,483 | B1 * | 11/2001 | Rotella | A63B 21/0552 482/121 |
| 6,368,255 | B1 * | 4/2002 | Chan-Rouse | A63B 23/00 482/126 |
| 6,840,894 | B2 * | 1/2005 | Lerner | A63B 21/0552 482/121 |
| 7,223,212 | B2 * | 5/2007 | DiOrio | A63B 21/0023 482/83 |
| 8,043,197 | B2 * | 10/2011 | Hetrick | A63B 21/018 482/91 |
| D676,091 | S * | 2/2013 | Henniger | D21/662 |
| 8,696,530 | B2 * | 4/2014 | Eubanks | A63B 21/1663 482/121 |
| 10,245,460 | B2 * | 4/2019 | Hetrick | A63B 21/4043 |
| 10,463,903 | B2 * | 11/2019 | Johnson | A63B 21/4011 |
| 2007/0173383 | A1 * | 7/2007 | Feigenbaum | A63B 21/1663 482/91 |
| 2010/0167885 | A1 * | 7/2010 | Kassel | A63B 21/4015 482/121 |

(Continued)

*Primary Examiner* — Andrew S Lo
(74) *Attorney, Agent, or Firm* — Steven Rinehart

(57) ABSTRACT

An elongated exercise strap formed from a single polymeric strap folded over itself and sewn together at predetermined intervals to form a plurality of loops, each loop affixable to a carabiner such that the carabiner is oriented orthogonally to the strap to prevent the carabiner from abrading the skin surface of a user.

11 Claims, 7 Drawing Sheets

(56) References Cited

U.S. PATENT DOCUMENTS

| | | | | |
|---|---|---|---|---|
| 2013/0157821 | A1* | 6/2013 | Crowell | A63B 21/068 482/129 |
| 2013/0165301 | A1* | 6/2013 | Thrasher-Rudd | A63B 23/03575 482/129 |
| 2014/0080687 | A1* | 3/2014 | Stuef | A63B 21/0442 482/129 |
| 2014/0200499 | A1* | 7/2014 | Champion | A63B 21/1663 602/36 |
| 2017/0151459 | A1* | 6/2017 | Abramovich | A63B 21/0557 |
| 2017/0225024 | A1* | 8/2017 | Thrasher-Rudd | A63B 21/00061 |
| 2017/0296857 | A1* | 10/2017 | Foster | A63B 21/4035 |
| 2018/0036575 | A1* | 2/2018 | Rawlins | A63B 21/1663 |
| 2018/0140894 | A1* | 5/2018 | Ross | A63B 21/028 |
| 2018/0153758 | A1* | 6/2018 | Foster | A63B 21/4035 |

* cited by examiner

SUSPENDIBLE EXERCISE STRAP

BACKGROUND OF THE INVENTION

Field of the Invention

This invention relates to exercise devices, and more particularly relates to inelastic exercise straps for performing a wide variety of exercises emphasizing core strength and hand grip.

Description of the Related Art

The need for people to engage in regular exercise and recreation is well established. Many and varied types of resilient handheld exercise devices are available to help individuals in their efforts to improve and measure their strength, their conditioning, and to mitigate specific health issues, as well as for physical therapy. Among these devices are dumbbells, barbells, exercise machines, or fixed objects, none of which emphasize the use of grip strength or building core strength. Conventional exercise apparati do not replicate or simulate the strength needed for real world activities.

Exercise straps are known in the art in some forms, and typically affix to an elevated structure with a single strap extending downwards. A handle is attached to the ends of each of the straps. A person places his or her hands in the handles and can perform various exercises, including push-ups and dips, using the straps. One disadvantage of suspension systems is that because the distance between the split and the ends of the two straps is relatively short, the straps may rub against the neck, ears, and head of the person during exercising. There exist no straps in the art which prevent this abrasion of the individual using the suspension system.

Resistance bands are likewise known in the art and have become popular among exercisers, personal trainers and physical therapist alike, typically consisting of rubber tubing of about five feet in length with handles on one end and a connector at the other end to secure the resistance band to an anchoring device.

There are a number of key deficiencies in these three forms of exercise straps. The present invention allows user to enjoy the benefits of exercise straps without the deficiencies in the prior art. It is therefore desirable that a suspendible exercise strap be provided as taught herein.

SUMMARY OF THE INVENTION

From the foregoing discussion, it should be apparent that a need exists for a suspendible exercise strap. Beneficially, such an apparatus would overcome many of the difficulties and safety concerns expressed, by providing an exercise strap which eliminates superfluous components and which does not abrade a user's skin.

The present invention has been developed in response to the problems and needs in the art that have not yet been fully solved by currently available apparati and methods. Accordingly, the present invention has been developed to provide a suspendible exercise strap comprising: an elongated polymeric strap folded over itself at a medial point to form a base strap member and a loop strap member; wherein the loop strap member is sewn at predetermined intervals to the base strap member such that the loop strap member forms a plurality of loops at the predetermined intervals; wherein the strap forms a first larger loop at a distal end of the exercise strap; wherein the strap forms a second larger loop at a proximal end of the exercise strap; wherein the loop strap member exceeds the length of the base strap member by more than 20 percent.

The suspendible exercise strap may further comprise: a detachable implement affixable to a loop using a carabiner, wherein the carabiner affixes to the strap; wherein a plane formed by the carabiner in an affixed configuration is substantially planar to the plane formed by a hand gripping a handle affixed to the carabiner.

In some embodiments, the suspendible exercise strap further comprises a sphere and a carabiner. The strap may be adapted to be wrapped around an overhead beam and fed back through one of the larger loops suspending the strap from the overhead beam.

A second suspendible exercise strap is also provided comprising: an elongated polymeric strap folded over itself at a medial point to form a base strap member and a loop strap member; wherein the loop strap member is sewn at predetermined intervals to the base strap member such that the loop strap member forms a plurality of loops at the predetermined intervals; wherein the strap forms a first larger loop at a distal end of the exercise strap; wherein the strap forms a second larger loop at a proximal end of the exercise strap; wherein the loop strap member exceeds the length of the base strap member by more than 15 percent; a detachable implement affixable to a loop using a carabiner, wherein the carabiner affixes to the strap; wherein a plane formed by the carabiner in an affixed configuration is substantially orthogonal to the plane formed by the base strap member.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

It an object of the present invention to provide a suspendible exercises strap of convenient design which does not abrade a user's skin, wrists, hands or body.

Figure 1:
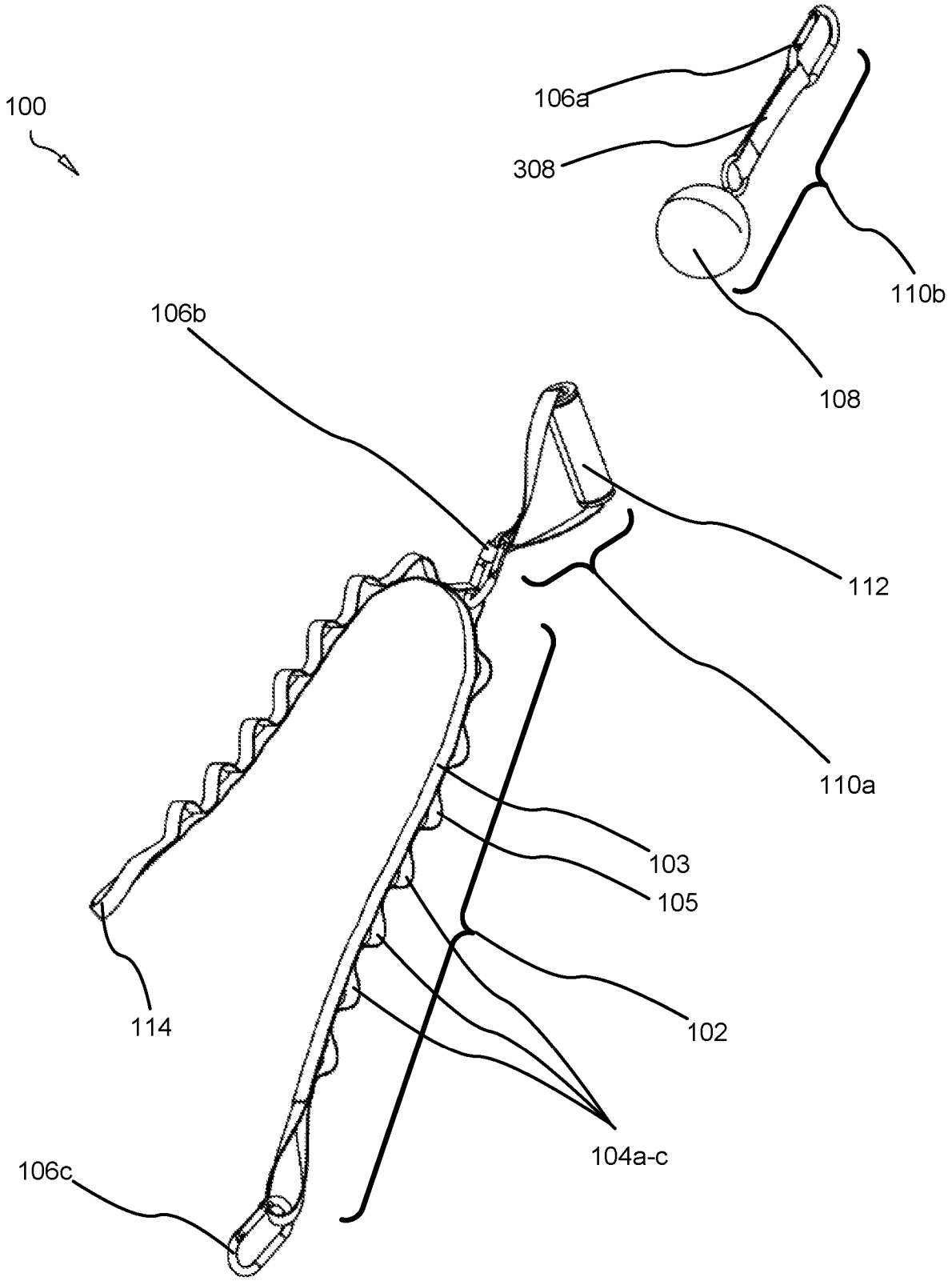
FIG. 1 is an isometric perspective view of a suspendible exercise strap in accordance with the present invention.

FIG. 1 is an isometric perspective view of a suspendible exercise strap 100 in accordance with the present invention.

The exercise strap 100 comprises a single, elongated polymeric strap 102 folded over itself at a distal end, forming a base strap member 103 and a loop strap member 105. The folded strap 102 is then sewn, using means known to those of skill in the art, back onto itself at evenly-spaced intervals. Between each evenly-spaced interval, the strap 102 forms a flexible loop 104, or attachment point, whereby various handheld gripping implements 110 may be detachably affixed. Because the loops 104 must be formed by greater length of the elongated strap 102 than the length necessary to form the loop from the base strap member 103, the base strap member is shorter in length than the loop strap member 105 by 10-40 percent.

A middle loop forms at a median point on the strap 100, which is affixed in the shown embodiment to the detachable implement 110 comprising a handle 112. In various embodiments, the strap 100 comprises 15 or more loops. The strap 100 may comprise two loops, one at a distal end and one a proximal end.

The detachable implement 100 may comprise a strap having a ball 108 as indicated at 110*b*. The detachable implements 110*a-b* both comprise a carabiner 106 which interlocks the strap 102 with the detachable implement.

Figure 2:
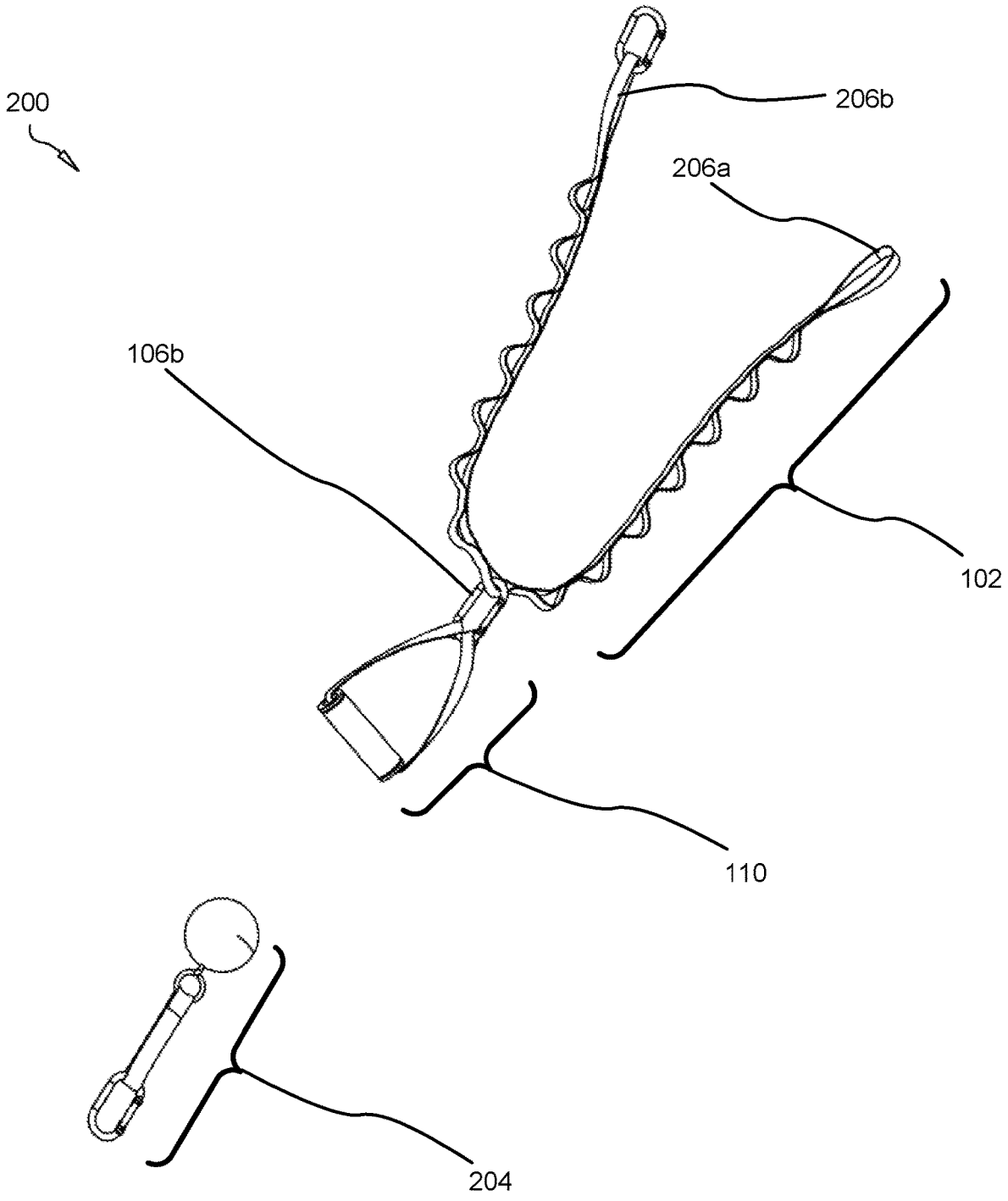
FIG. 2 is a top perspective view of a suspendible exercise strap in accordance with the present invention.

FIG. 2 is a top perspective view of a suspendible exercise strap 200 in accordance with the present invention.

The detachable implements 110 are affixed to the strap 200 using a carabiner 106 such that the carabiner 106 orients in a substantially parallel orientation with a user's hands and arms while engaged with the strap 200. It is an object of the present invention to provide a strap for achieving this function to prevent direction wear between the carabiner 106 and the user—and deficiency not overcome in the prior art. Even periodic rubbing between the carabiner and a hand or arm of the user causing abrasion, bruising and skin damage which can render the exercise strap inutile.

The plane formed by the carabiner 106 is orthogonal to the plane formed by base strap member. The plane formed by the carabiner 106 sits in substantially the same plane at the plane formed a user's hand gripping the handle 112.

The strap 200 comprises large loops 106*a-b* at the distal and proximal ends. These loops 206*a-b* are adapted to wrap around an overhead beam or support, and for the main body of the strap 102 to be fed back through the larger loop 206 around the beam, thus securing the strap 200 without the need for additional ropes, hooks, and attachment mechanisms.

Figure 3:
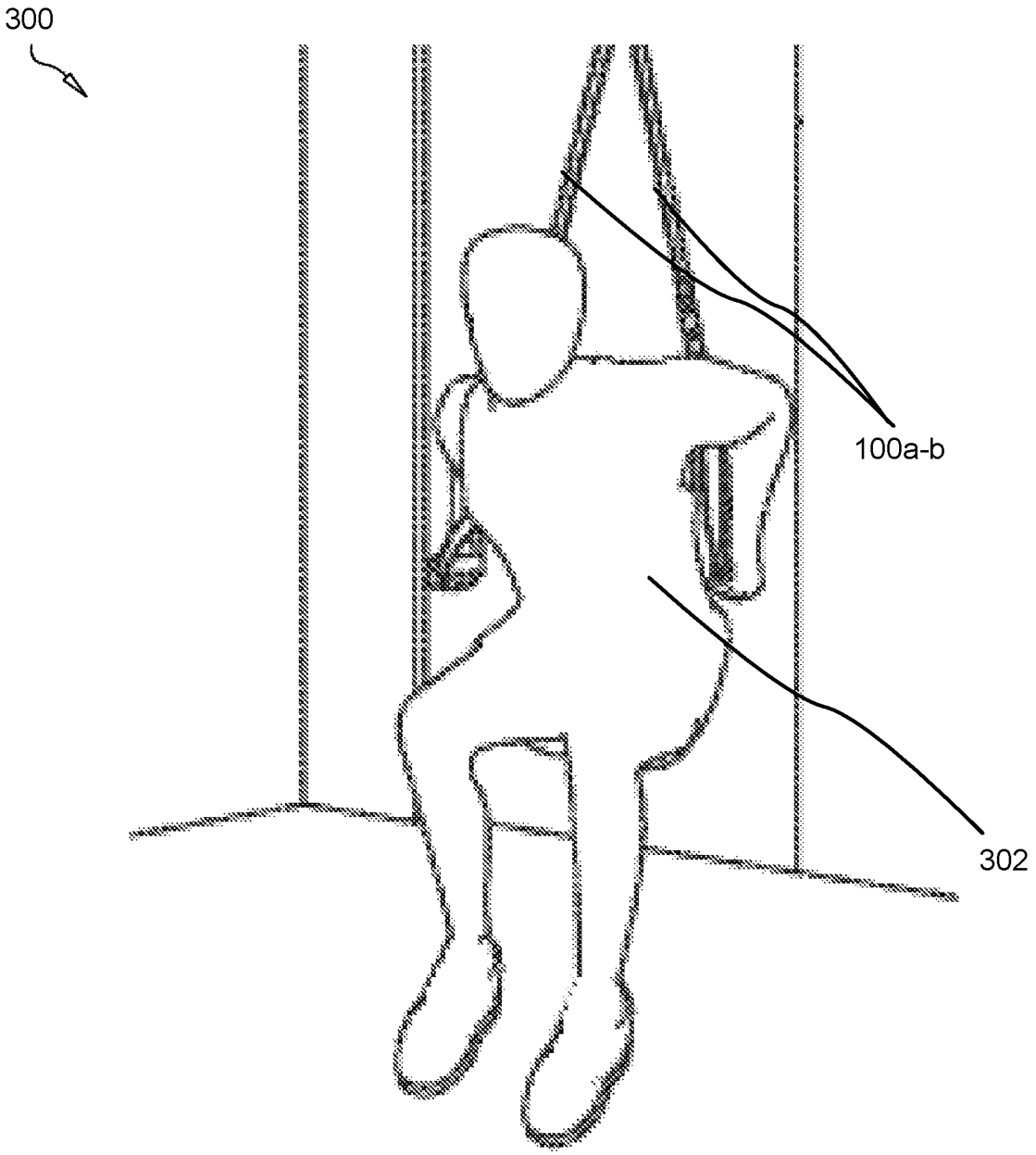
FIG. 3 is an environmental, forward perspective view of a suspendible exercise strap in accordance with the present invention.

FIG. 3 is an environmental, forward perspective view of a suspendible exercise strap in accordance with the present invention.

Two straps 300 are suspended from a door frame in the shown embodiment. Using a pair of straps 300, a user is able to perform squats with handles 112 affixed to the strap at a predetermined height.

Figure 4:
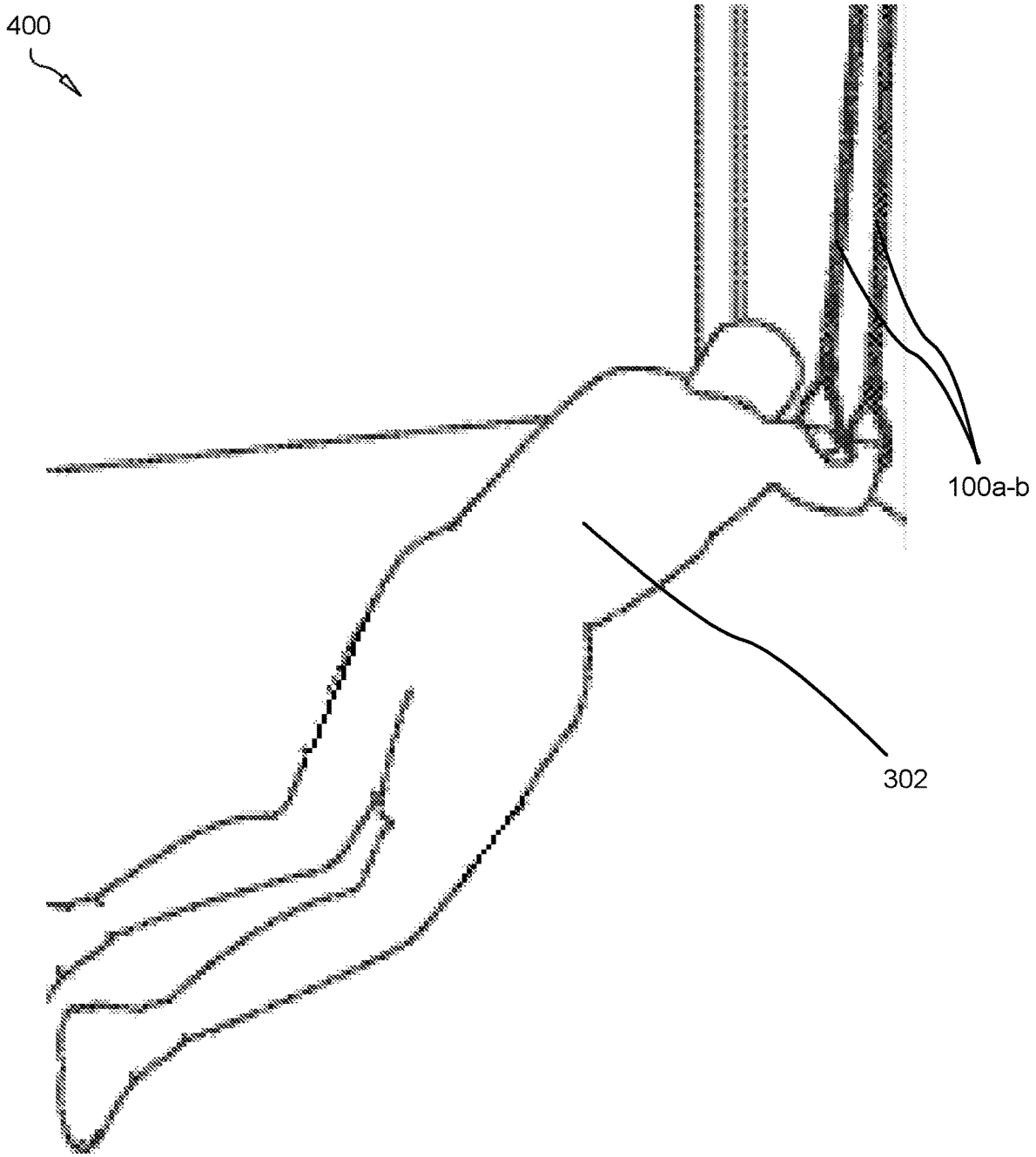
FIG. 4 is an environmental, forward perspective view of a suspendible exercise strap in accordance with the present invention.

FIG. 4 is an environmental, forward perspective view of a suspendible exercise strap in accordance with the present invention.

Two straps 300 are suspended from an overhead beam in the shown embodiment. Using a pair of straps 300, a user is able to perform butterflies with handles 112 affixed to the strap at a predetermined height.

Figure 5:
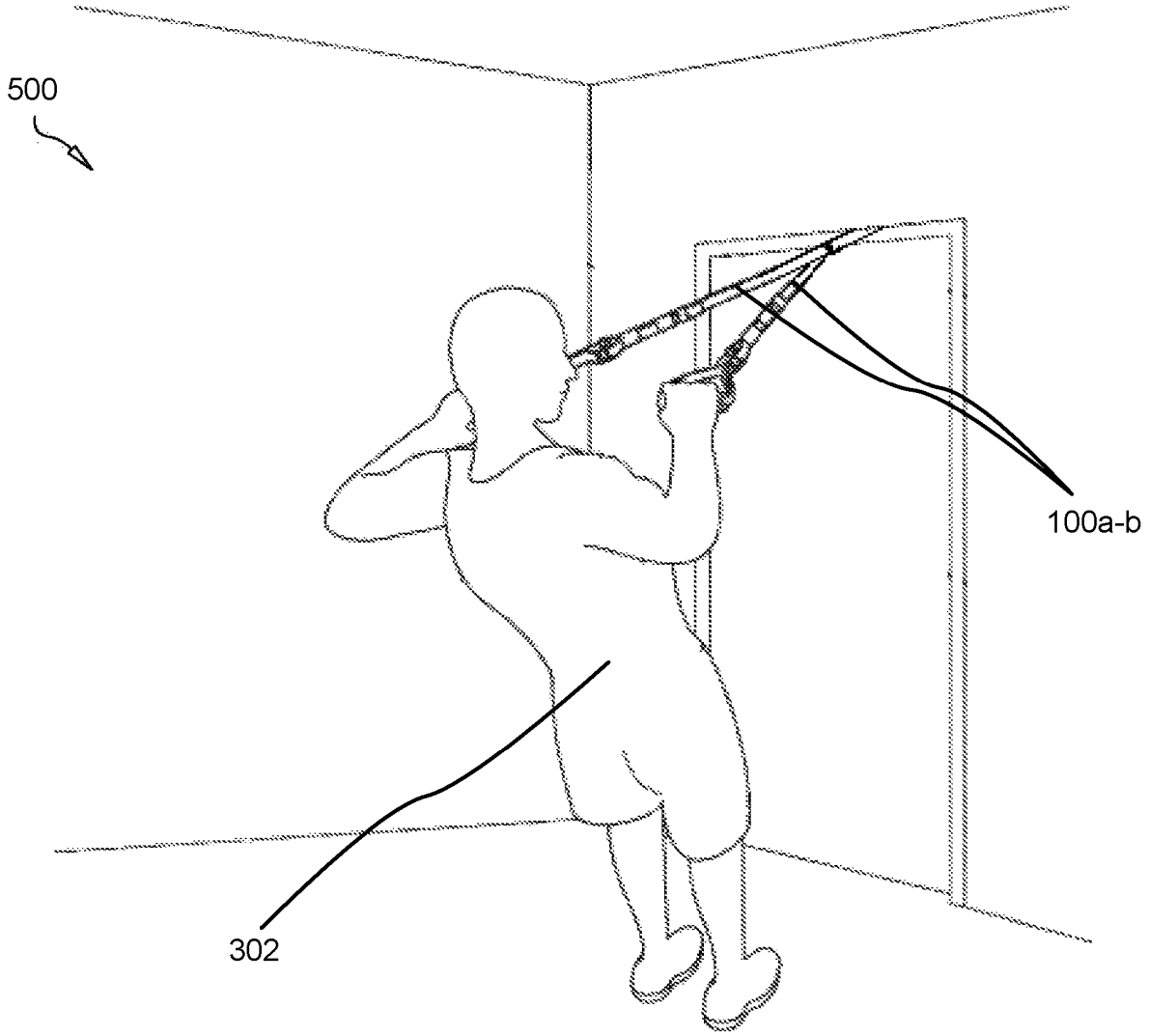
FIG. 5 is an environmental, forward perspective view of a suspendible exercise strap in accordance with the present invention.

FIG. 5 is an environmental, forward perspective view of a suspendible exercise strap in accordance with the present invention.

Two straps 300 are suspended from a door frame in the shown embodiment. Using a pair of straps 300, a user is able to perform standing rows with handles 112 affixed to the strap at a predetermined height.

Figure 6:
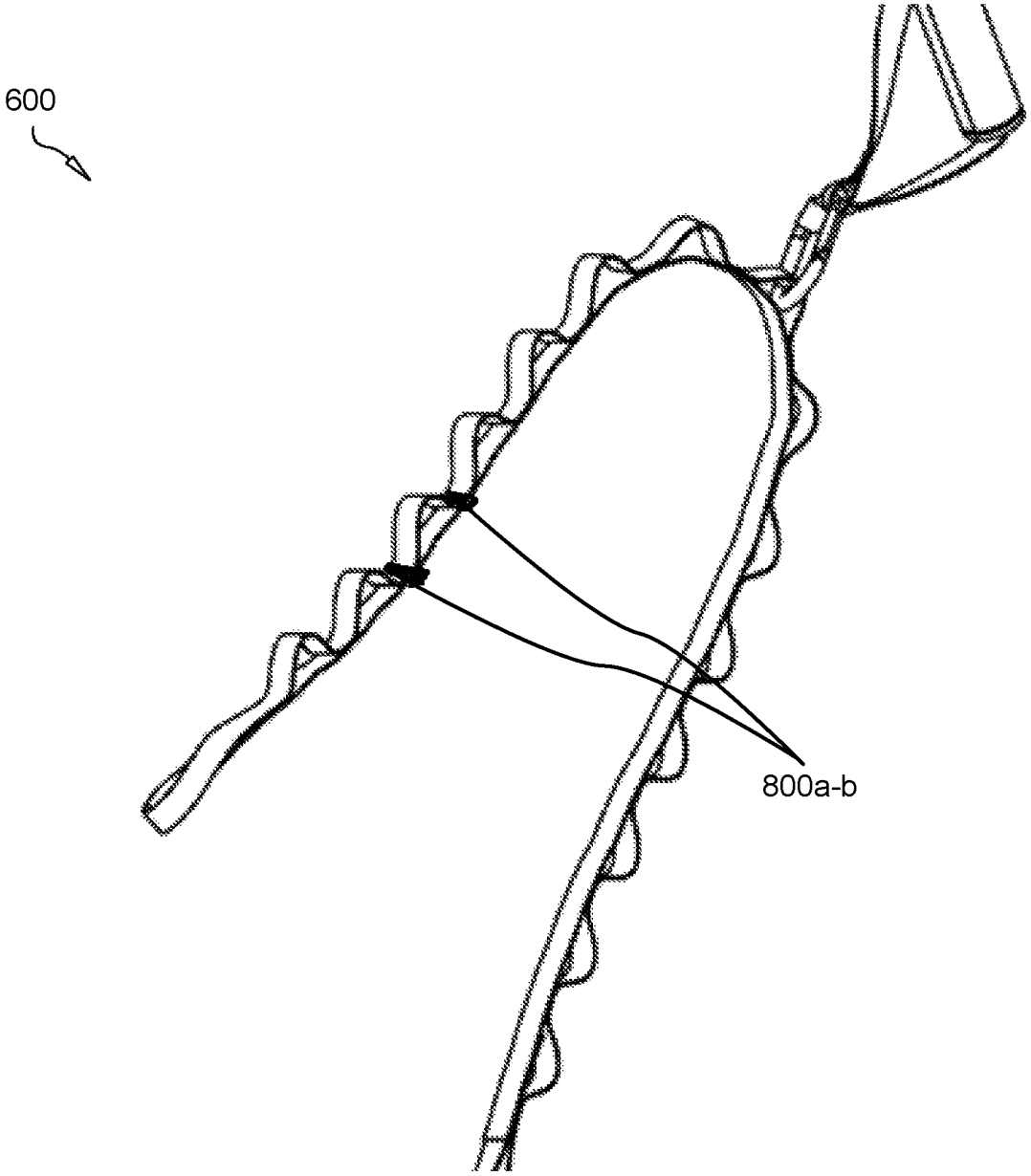
FIG. 6 is an isometric perspective view of a suspendible exercise strap in accordance with the present invention.

FIG. 6 is an isometric perspective view of a suspendible exercise strap 600 in accordance with the present invention.

In various embodiments, the loops 104 are formed by affixing a plurality of clips 800 at evenly-spaced, or unevenly-spaced, intervals in place of stitching. These clips 800 are detachable such that the loops 104 are formed by a friction fit formed between the strap 104 and the clip 800. The clips 800 may have teeth as further described below.

Figure 7:
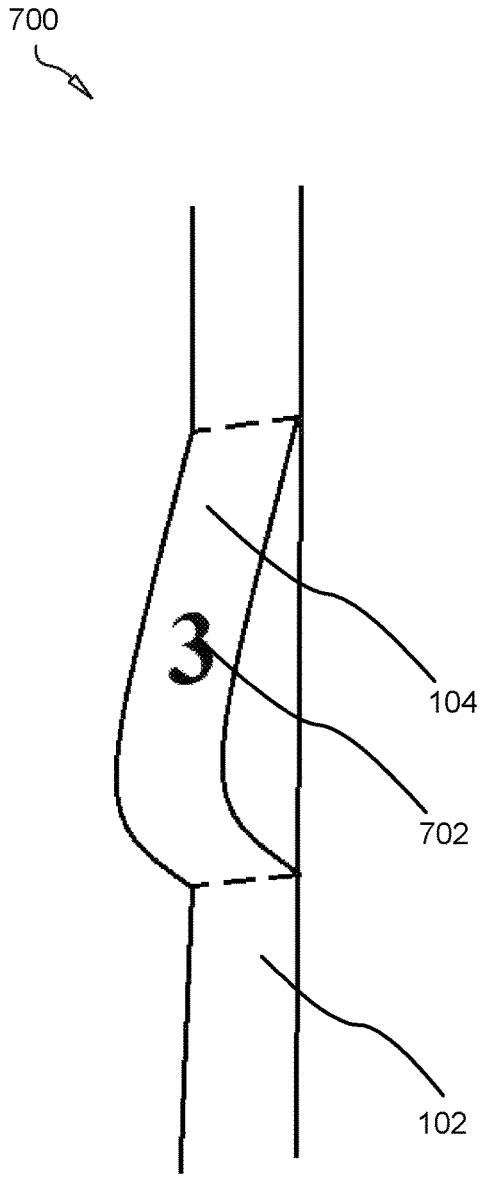
FIG. 7 is a forward perspective view of a suspendible exercise strap in accordance with the present invention.

FIG. 7 is a forward perspective view of a suspendible exercise strap 700 in accordance with the present invention.

In various embodiments, the loop 104 is metered to display the distance from the loop 114 to the metered loop 104. In various embodiments, each numeral 702 is sequentially numbered starting with one. In other embodiments, the numeral 702 represents a distance in feet, inches, centimeters, meters or another metric. There may be 15 loops 104 in some embodiments.

Figure 8:
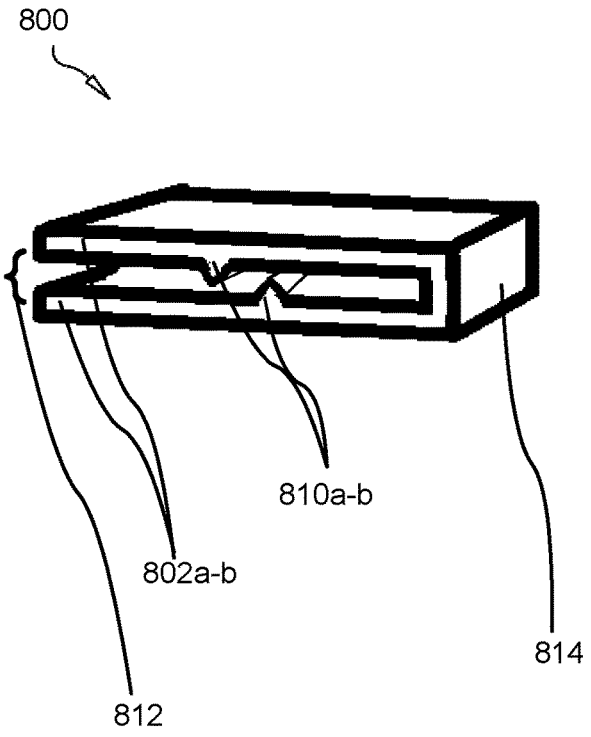
FIG. 8 is a side perspective view of a clip of a suspendible exercise strap in accordance with the present invention.

FIG. 8 is a side perspective view of a clip 800 of a suspendible exercise strap in accordance with the present invention.

The clip 800 comprises a U-shaped or arcuate fastener as shown, which doubles back over itself. In various embodiments, two plates 802 of the clip 800 are affixed at one side 814, forming a recess 812 between them. The strap 104 is received by this recess. The interior surfacing of the recess 812 may comprise a plurality of teeth 810 adapted to bite into the strap 104 and prevent the strap 104, folded over itself, from moving during exercise. The teeth 810 may be stagger across any interior axis of the recess 812.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A suspendible exercise strap comprising:

an elongated polymeric strap folded over itself at a medial point to form a base strap member and a loop strap member;

wherein the loop strap member is sewn at predetermined intervals to the base strap member such that the loop strap member forms a plurality of loops at the predetermined intervals;

wherein the strap forms a first larger loop at a distal end of the exercise strap;

wherein the strap forms a second larger loop at a proximal end of the exercise strap, wherein the first larger loop and the second larger loop are greater in diameter than the plurality of loops between the distal and proximal ends;

wherein the loop strap member exceeds the length of the base strap member by more than 20 percent;

a plurality of clips, each clip comprising a U-shaped fastener having:

two plates affixed at one side forming a recess between them, and interior surfacing comprising a plurality of teeth adapted to bite into the strap and prevent movement of the strap during exercise;

wherein each clip is adapted to position between loops and reduce a diameter of a loop over which each clip is positioned.

2. The suspendible exercise strap of claim 1, further comprising:

a detachable implement affixable to a loop using a carabiner, wherein the carabiner affixes to the strap;

wherein a plane formed by the carabiner in an affixed configuration is substantially planar to the plane formed by a hand gripping a handle affixed to the carabiner to prevent direction wear between the carabiner and a user; and wherein the plane is orthogonal to a plane formed by the base strap member;

a second carabiner, wherein the second carabiner is affixed to the first larger loop or the second larger loop.

3. The suspendible exercise strap of claim 1, further comprising a sphere and a carabiner.

4. The suspendible exercise strap of claim 1, wherein the strap is adapted to be wrapped around an overhead beam and fed back through one of the larger loops suspending the strap from the overhead beam.

5. The suspendible exercise strap assembly of claim 1, wherein the teeth are staggered across the interior surfacing.

6. The suspendible exercise strap assembly of claim 1, wherein the teeth are offset from one another and each tooth is spaced a lateral distance away from all other teeth tooth.

7. The suspendible exercise strap assembly of claim 1, wherein each clip is configured to position between stitched loops.

8. A suspendible exercise strap assembly comprising:

two elongated polymeric straps, each strap folded over itself at a medial point to form a base strap member and a loop strap member;

wherein the loop strap member is affixed at unevenly-spaced intervals to the base strap member using a plurality of clips such that the loop strap member forms a plurality of loops at the unevenly-spaced intervals;

wherein each clip comprises a U-shaped fastener having:

two plates affixed at one side forming a recess between them, and interior surfacing comprising a plurality of teeth adapted to bite into the strap and prevent movement of the strap during exercise;

wherein each clip is adapted to position between loops and reduce a diameter of a loop over which each clip is positioned;

wherein the strap forms a first larger loop at a distal end of the exercise strap;

wherein the strap forms a second larger loop at a proximal end of the exercise strap;

wherein the loop strap member exceeds the length of the base strap member by more than 15 percent;

a detachable implement affixable to a loop using a carabiner, wherein the carabiner affixes to the strap;

wherein a plane formed by the carabiner in an affixed configuration is substantially orthogonal to the plane formed by the base strap member.

9. The suspendible exercise strap assembly of claim 8, wherein the teeth are staggered across the interior surfacing.

10. The suspendible exercise strap assembly of claim 8, wherein the teeth are offset from one another and each tooth is spaced a lateral distance away from all other teeth tooth.

11. The suspendible exercise strap assembly of claim 8, wherein each clip is configured to position between stitched loops.

* * * * *